US011761463B2

(12) United States Patent
Watanabe et al.

(10) Patent No.: US 11,761,463 B2
(45) Date of Patent: Sep. 19, 2023

(54) FLUID ACTUATOR, FLUID ACTUATOR CONTROL METHOD, AND COMPUTER READABLE MEDIUM STORING CONTROL PROGRAM OF FLUID ACTUATOR

(71) Applicant: SUMITOMO HEAVY INDUSTRIES, LTD., Tokyo (JP)

(72) Inventors: Marino Watanabe, Kanagawa (JP); Akira Kondo, Kanagawa (JP); Shinya Hamada, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/573,967

(22) Filed: Jan. 12, 2022

(65) Prior Publication Data

US 2022/0220985 A1 Jul. 14, 2022

(30) Foreign Application Priority Data

Jan. 13, 2021 (JP) ..... 2021-003200

(51) Int. Cl.
*F15B 15/20* (2006.01)

(52) U.S. Cl.
CPC ..... *F15B 15/20* (2013.01); *F15B 2211/6306* (2013.01); *F15B 2211/6336* (2013.01)

(58) Field of Classification Search
CPC .... F15B 11/02; F15B 20/00; F15B 2211/755; F15B 2211/8755
See application file for complete search history.

(56) References Cited

U.S. PATENT DOCUMENTS 4,970,941 A * 11/1990 Reinhardt ..... F15B 11/02 137/884
5,305,681 A * 4/1994 Devier ..... E02F 9/2025 60/462
6,789,558 B2 * 9/2004 Coakley ..... G05D 7/0635 251/129.05
2013/0276516 A1 * 10/2013 Tabor ..... G01M 3/26 73/37
2017/0080641 A1 * 3/2017 El-Siblani ..... B33Y 30/00

FOREIGN PATENT DOCUMENTS

EP 3450774 B1 * 7/2021 ..... F15B 11/10
JP 2004-205022 A 7/2004
JP 2004205022 A * 7/2004

* cited by examiner

*Primary Examiner* — Thomas E Lazo
(74) *Attorney, Agent, or Firm* — Michael Best & Friedrich LLP

(57) ABSTRACT

Provided is a fluid actuator capable of safely driving a drive target. An air actuator using air as a working fluid includes an X-axis pressure sensor that measures air pressures PX+ and PX− along one drive axis, which drives a drive target in an X direction, a Y-axis pressure sensor that measures air pressures PY1+, PY1−, PY2+, and PY2− along two drive axes, which drive the drive target in a Y direction, and an acceleration detection unit that detects translational acceleration and rotational acceleration generated in the drive target on the basis of the measured air pressures PX+, PX−, PY1+, PY1−, PY2+, and PY2−.

10 Claims, 7 Drawing Sheets

FLUID ACTUATOR, FLUID ACTUATOR CONTROL METHOD, AND COMPUTER READABLE MEDIUM STORING CONTROL PROGRAM OF FLUID ACTUATOR

RELATED APPLICATIONS

The content of Japanese Patent Application No. 2021-003200, on the basis of which priority benefits are claimed in an accompanying application data sheet, is in its entirety incorporated herein by reference.

BACKGROUND

Technical Field

Certain embodiments of the present invention relate to a control technique for a fluid actuator.

Description of Related Art

In air actuators that use air as a working fluid and drive a drive target with the pressure (also referred to as driving pressure) of air, there is known a technique for emergency-stopping the drive when an abnormality occurs.

SUMMARY

According to an embodiment of the present invention, there is provided a fluid actuator including a first pressure sensor that measures a pressure of a working fluid that drives a drive target in a first drive direction; a second pressure sensor that measures the pressure of the working fluid that drives the drive target in a second drive direction different from the first drive direction; and an acceleration detection unit that detects an acceleration generated in the drive target on the basis of the pressure measured by the first pressure sensor and the pressure measured by the second pressure sensor.

According to this aspect, the acceleration generated in the drive target can be detected on the basis of the pressures measured by the two pressure sensors corresponding to the different drive directions. Accordingly, the drive target can be safely driven while being monitored such that the acceleration does not become excessive.

Another aspect of the present invention is a fluid actuator control method. This method includes measuring a pressure of a working fluid that drives a drive target in a first drive direction, by a first pressure sensor; measuring a pressure of the working fluid that drives the drive target in a second drive direction different from the first drive direction, by a second pressure sensor; and detecting an acceleration generated in the drive target on the basis of the pressure measured by the first pressure sensor and the pressure measured by the second pressure sensor.

In addition, optional combinations of the above components and those obtained by exchanging the expressions of the present invention with each other between methods, devices, systems, recording media, computer programs, and the like are also effective as aspects of the present invention.

DETAILED DESCRIPTION

Figure 1B:
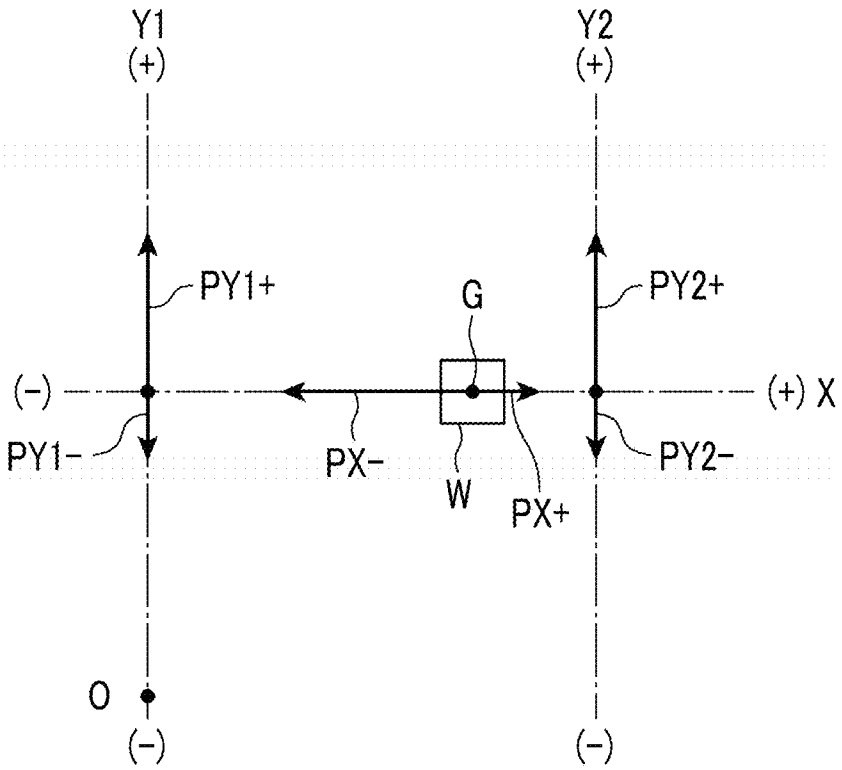
FIGS. 1A and 1B are views showing the concept of a fluid actuator of the present embodiment.

At the time of emergency stop of the air actuators, even when the driving pressure is lowered or the driving pressure is applied in a direction opposite to a drive direction before the emergency stop, it is difficult to stop a drive target instantly due to the inertia of the drive target during driving. In a case where the drive target is driven at high speed, there is also a possibility that the drive target collides with other parts of the air actuator before the drive target stops.

The present invention has been made in view of such a situation, it is desirable to provide a fluid actuator capable of safely driving a drive target.

Hereinafter, embodiments for carrying out the present invention will be described in detail with reference to the drawings. In the description and drawings, the same or equivalent components, members, and processing are designated by the same reference numerals, and redundant descriptions will be appropriately omitted. The scales and shapes of the respective parts shown in the figures are set for convenience in order to facilitate the description, and should not be interpreted as limiting unless otherwise specified. The embodiments are merely examples and do not limit the scope of the present invention. All the features and combinations to be described in the embodiments are not necessarily essential to the invention.

Figure 1A:
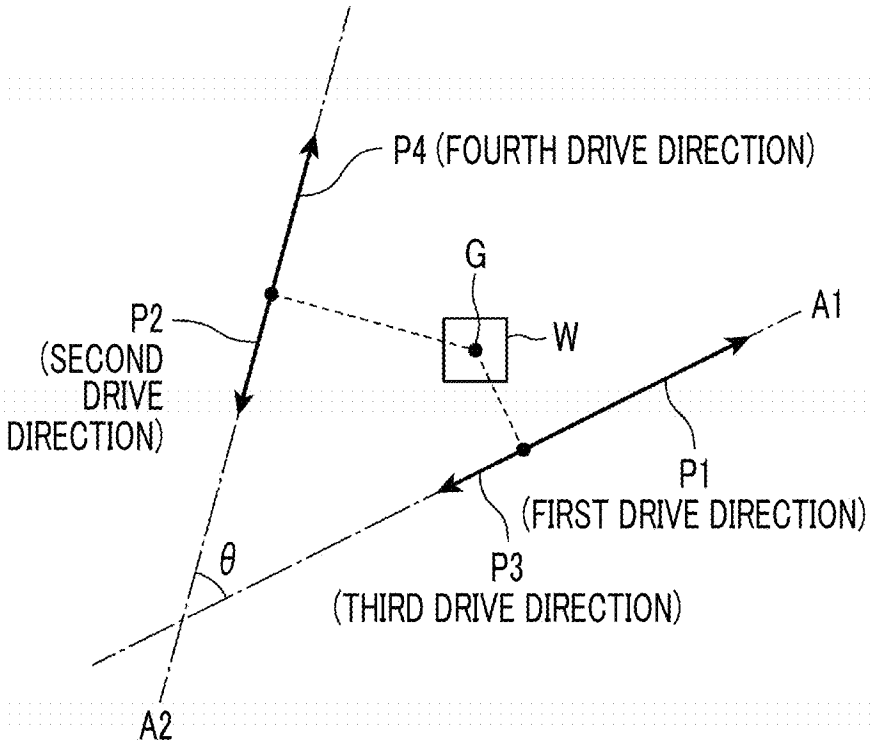

FIGS. 1A and 1B show the concept of a fluid actuator of the present embodiment. FIG. 1A shows a generalized concept, and FIG. 1B shows a concept according to a specific example described below. In FIG. 1A, W is a drive target driven by the fluid actuator, and G represents the center of gravity thereof. The fluid actuator has at least one drive axis and, in the shown example, has two different drive axes A1 and A2. The relationship between the two drive axes A1 and A2 is optional, and an angle θ formed in a case where the drive axes are provided in the same plane is optionally set (in a case where A1 and A2 are parallel to each other, θ=0°). Typically, as shown in FIG. 1B, drive axes X, Y1, and Y2 are parallel to each other (θ=0°) or perpendicular (θ=90°) to each other. A case where all the drive axes of the fluid actuator are in the same plane will be described below, but the concept of the invention is that the drive axes may not be in the same plane and may be at mutually twisted positions, for example.

One direction along the drive axis A1 is referred to as a first drive direction, a direction opposite to the first drive direction on the same drive axis A1 is referred to as a third drive direction, one direction along the drive axis A2 is referred to as a second drive direction, and a direction opposite to the second drive direction on the same drive axis A2 is referred to as a fourth drive direction. In this way, the "drive directions" are defined by the drive axes and the directions on the drive axes. On the drive axis A1, a pressure P1 along the first drive direction and a pressure P3 along the third drive direction are applied to a drive target W. On the drive axis A2, a pressure P2 along the second drive direction and a pressure P4 along the fourth drive direction are applied to the drive target W. By combining the pressures P1 to P4, the drive target W can be optionally driven in the same plane. In other words, the combination of the pressures P1 to P4 causes an optional acceleration in the drive target W. For example, the combination of the pressures P1 and P3 along the drive axis A1 causes translational acceleration along the drive axis A1, and the combination of the pressures P2 and P4 along the drive axis A2 causes translational acceleration along the drive axis A2. Additionally, the combination of pressures between the different drive axes A1 and A2 (for example, P1 and P2) causes rotational acceleration (angular acceleration) in addition to the translational acceleration. The fluid actuator of the present embodiment improves safety during driving by monitoring various accelerations generated in the drive target W by the pressures P1 to P4.

In FIG. 1B, the three drive axes X, Y1, and Y2 are provided. The drive axis X passes through the center of gravity G of the drive target W. The drive axes Y1 and Y2 are provided with the drive target W sandwiched therebetween and are parallel to each other and perpendicular to the drive axis X. Hereinafter, the drive axes X, Y1, and Y2 are also referred to as an X axis, a Y1 axis, and a Y2 axis, respectively, and the respective directions are also referred to as an X direction, a Y1 direction, and a Y2 direction. Additionally, the drive axes Y1 and Y2 are collectively referred to as a Y axis, and the direction thereof is also referred to as a Y direction. On the drive axis X, a pressure PX− along a drive direction from a positive side to a negative side in the X direction and a pressure PX+ along a drive direction from the negative side to the positive side in the X direction are applied to the drive target W. On the drive axis Y1, a pressure PY1− along a drive direction from a positive side to a negative side in the Y1 direction and a pressure PY1+ along a drive direction from the negative side to the positive side in the Y1 direction are applied to the drive target W. On the drive axis Y2, a pressure PY2− along a drive direction from a positive side to a negative side in the Y2 direction and a pressure PY2+ along a drive direction from the negative side to the positive side in the Y2 direction are applied to the drive target W.

Combinations (PX−, PX+), (PY1−, PY1+), (PY2−, PY2+) of pressures along the respective drive axes X, Y1, and Y2 cause translational accelerations along the respective drive axes X, Y1, and Y2. Additionally, the combinations of pressures between the different drive axes X, Y1, and Y2 cause rotational accelerations in addition to the translational accelerations. The rotational accelerations are particularly caused by combinations of pressures on the Y1 axis and the Y2 axis. For example, a combination of PY1− and PY2+ causes a counterclockwise rotational acceleration in FIGS. 1A and 1B, and a combination of PY1+ and PY2− causes a clockwise rotational acceleration in FIGS. 1A and 1B. Additionally, a combination of PY1− and PY2− causes a rotational acceleration according to a magnitude relationship thereof. That is, a counterclockwise rotational acceleration is generated in a case where PY1− is larger than PY2−, and a clockwise rotational acceleration is generated in a case where PY1− is smaller than PY2−. Similarly, a combination of PY1+ and PY2+ also causes rotational acceleration according to the magnitude relationship thereof. That is, a clockwise rotational acceleration is generated in a case where PY1+ is larger than PY2+, and a counterclockwise rotational acceleration is generated in a case where PY1+ is smaller than PY2+. The fluid actuator of the present embodiment monitors the translational accelerations along the respective drive axes X, Y1, and Y2 on the basis of the comparison of opposite pressures on the respective drive axes X, Y1, and Y2 and also monitors the rotational accelerations on the basis of the comparison of pressures on the Y1 axis and the Y2 axis, thereby improving the safety during driving. In addition, the acceleration generated in the drive target W can be uniquely obtained by mechanical calculation based on the measured values of the pressures PX−, PX+, PY1−, PY1+, PY2−, and PY2+, and the relative positions of the drive target W with respect to the drive axes X, Y1, and Y2 (measurable by position sensors 140 and 142 described below). Accordingly, instead of individually comparing the measured values of the two pressures as described above, the acceleration may be obtained at once by using a function having the respective measured values as variables. As is clear from the above description, the present invention is suitable for a multi-axis fluid actuator having a plurality of drive axes.

Figure 2:
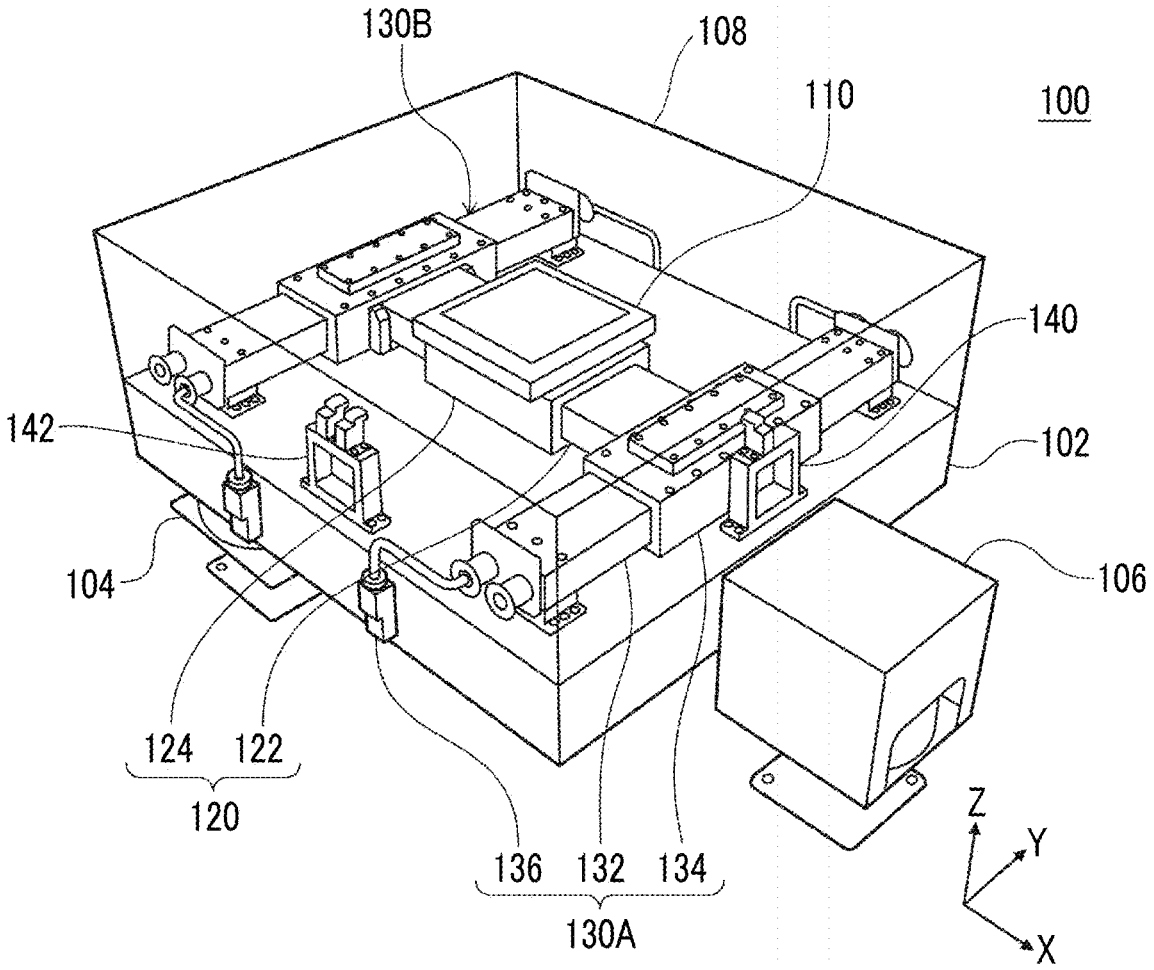
FIG. 2 is a perspective view of an air stage to which the fluid actuator of the present embodiment is applied.

FIG. 2 is a perspective view of an air stage to which the fluid actuator of the present embodiment is applied. An air stage 100 mainly includes a platen 102, an anti-vibration table 104, an anti-vibration device 106, a workpiece table 110, one X-axis air actuator 120 extending along the X axis, and two Y-axis air actuators 130A and 130B (hereinafter, collectively referred to as a Y-axis air actuator 130) extending along the Y axis. The platen 102 is supported by the anti-vibration table 104. The X-axis air actuator 120 and the Y-axis air actuators 130A and 130B form an H shape as viewed from above. The anti-vibration device 106 absorbs the force caused by the movement of the X-axis air actuator 120 and the Y-axis air actuators 130A and 130B and the vibration from a floor and suppresses the vibration of the platen 102.

The X-axis air actuator 120 and the Y-axis air actuator 130 are fluid actuators that drive the workpiece table 110, which is a drive target, along the X axis and the Y axis, respectively, by using air, which is a gas, as a working fluid. The X-axis air actuator 120 has a guide (square shaft) 122, a slider 124, and a servo valve 126 (not shown). Similarly, the Y-axis air actuators 130A and 130B each have a guide 132, a slider 134, and a servo valve 136, respectively. Both ends of the X-axis guide 122 are respectively supported by the sliders 134 of the Y-axis air actuators 130A and 130B. The slider 124 moves in the X direction along the guide 122. The X-axis air actuator 120 moves in the Y direction along the guide 132 as the slider 134 moves. In this way, the air stage 100 moves the workpiece table 110 together with the slider 124 in the XY plane. The workpiece table 110, the X-axis air actuator 120, and the Y-axis air actuators 130A and 130B are placed in a vacuum environment covered with a casing 108.

In the X-axis air actuator 120, the slider 124 constitutes a first drive unit that drives the workpiece table 110 serving as a drive target along the guide 122 that constitutes the X axis, which is a first drive axis. In the Y-axis air actuator 130B, the slider 134 constitutes a second drive unit that drives the workpiece table 110 serving as a drive target along the guide 132 that constitutes the Y1 axis, which is a second drive axis. Similarly, in the Y-axis air actuator 130A, the slider 134 constitutes a third drive unit that drives the workpiece table 110 serving as a drive target along the guide 132 that constitutes the Y2 axis, which is a third drive axis parallel to the Y1 axis. The Y-axis air actuators 130A and 130B are provided with the workpiece table 110 interposed therebetween. Additionally, the servo valves 126 and 136 constitute a driving pressure generating unit that supplies air at a pressure commanded by the controller 200 (FIG. 3) to the sliders 124 and 134.

The position sensor 140 measures the position of the workpiece table 110 in the X direction. Additionally, the position sensor 142 measures the position of the workpiece table 110 in the Y direction. By differentiating the measured positions in the X and Y directions with respect to time, velocities in the X direction and the Y direction can be obtained. Additionally, by differentiating the velocities in the X direction and the Y direction with respect to time, accelerations in the X and Y directions can be obtained.

Figure 3:
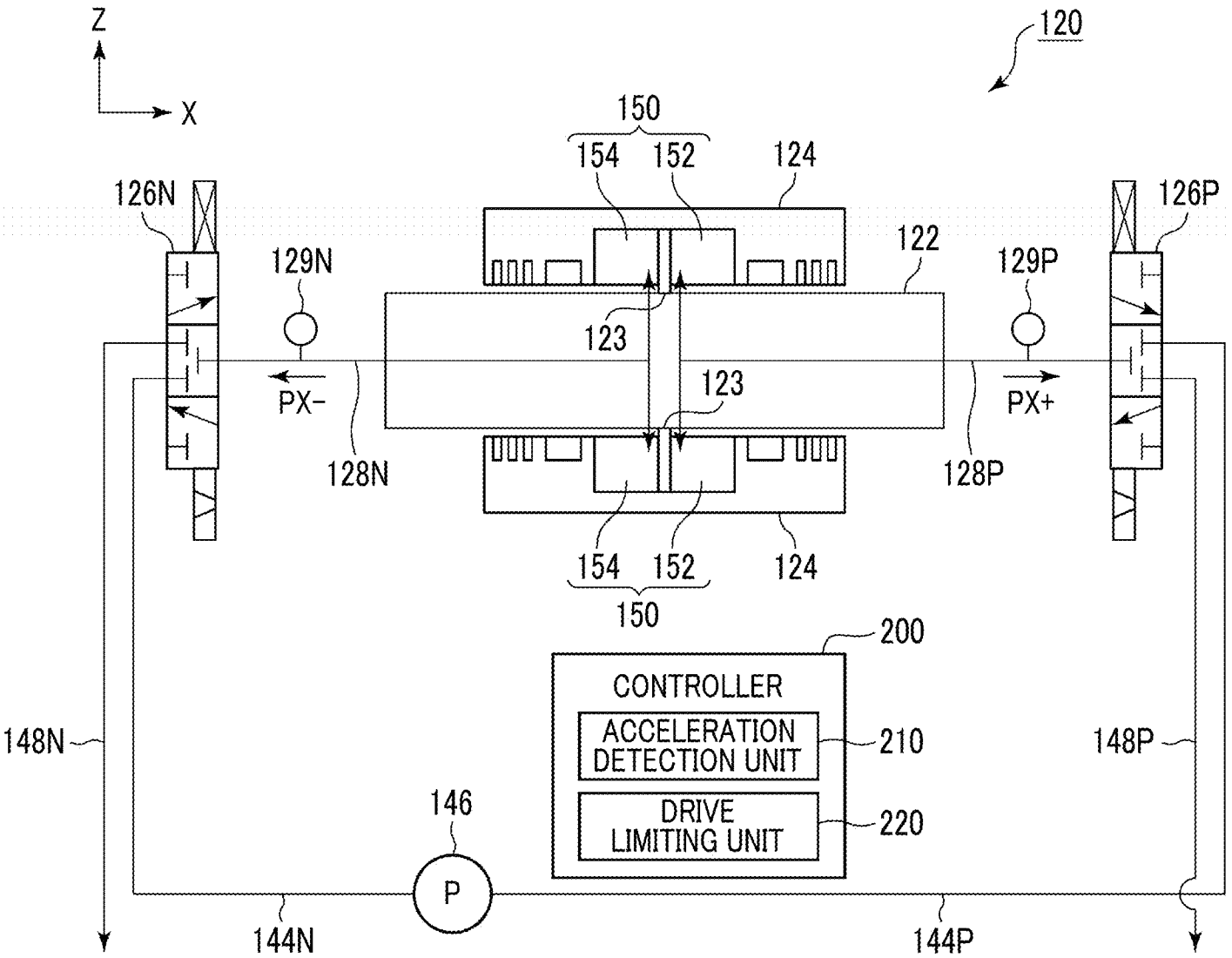
FIG. 3 is a schematic sectional view of an air actuator.

FIG. 3 is a schematic sectional view of the air actuator. Specifically, a longitudinal section of the X-axis guide 122 at the center in the Y direction is schematically shown.

A hydrostatic bearing is formed between the guide 122 and the slider 124, and the slider 124 floats from the guide 122 and is movable in the X direction in complete non-contact, due to the air pressure constantly supplied between an outer peripheral surface of the guide 122 and an inner peripheral surface of the slider 124. In addition, although not shown, the workpiece table 110 is fixed to a +Z-side surface of the slider 124 and moves integrally with the slider 124 along the X axis.

The slider 124 is provided with a servo chamber 150 that is an internal space. The servo chamber 150 is partitioned into a positive-side chamber 152 and a negative-side chamber 154 by a pressure-receiving plate 123 fixed to the guide 122.

The X-axis air actuator 120 includes a positive-side servo valve 126P and a negative-side servo valve 126N that are respectively disposed on the positive side and the negative side of the X axis. The slider 124 is driven by the positive-side servo valve 126P and the negative-side servo valve 126N. The positive-side servo valve 126P and the negative-side servo valve 126N control the intake/exhaust amount of the positive-side chamber 152 and the negative-side chamber 154 depending on the position of a spool to be described below. The positive-side servo valve 126P communicates with the positive-side chamber 152 via a positive-side pipe 128P. The negative-side servo valve 126N communicates with the negative-side chamber 154 via a negative-side pipe 128N.

The X-axis air actuator 120 controls the positive-side servo valve 126P and the negative-side servo valve 126N to generate a differential pressure in the positive-side chamber 152 and the negative-side chamber 154. The velocity and acceleration of the slider 124 with respect to the guide 122 are controlled by the differential pressure.

The positive-side servo valve 126P and the negative-side servo valve 126N are connected to a pump 146 as an air supply source via a positive-side air supply pipe 144P and a negative-side air supply pipe 144N, respectively. Additionally, the positive-side servo valve 126P and the negative-side servo valve 126N discharge air to the outside of a casing 108 via a positive-side air discharge pipe 148P and a negative-side air discharge pipe 148N, respectively. The air from the pump 146 is supplied to the positive-side chamber 152 via the positive-side air supply pipe 144P, the positive-side servo valve 126P, and the positive-side pipe 128P. That is, the positive-side air supply pipe 144P, the positive-side servo valve 126P, and the positive-side pipe 128P constitute a positive-side air supply flow path. Similarly, the air from the pump 146 is supplied to the negative-side chamber 154 via the negative-side air supply pipe 144N, the negative-side servo valve 126N, and the negative-side pipe 128N. That is, the negative-side air supply pipe 144N, the negative-side servo valve 126N, and the negative-side pipe 128N constitute a negative-side air supply flow path. The air in the positive-side chamber 152 is discharged to the outside via the positive-side pipe 128P, the positive-side servo valve 126P, and the positive-side air discharge pipe 148P. That is, the positive-side pipe 128P, the positive-side servo valve 126P, and the positive-side air discharge pipe 148P constitute a positive-side air discharge flow path. Similarly, the air in the negative-side chamber 154 is discharged to the outside through the negative-side pipe 128N, the negative-side servo valve 126N, and the negative-side air discharge pipe 148N. That is, the negative-side pipe 128N, the negative-side servo valve 126N, and the negative-side air discharge pipe 148N constitute a negative-side air discharge flow path.

The air stage 100 includes the controller 200 that controls the positive-side servo valve 126P and the negative-side servo valve 126N. Although the X-axis air actuator 120 has been described above as an example, the Y-axis air actuator 130 can be similarly configured. The controller 200 controls the positive-side servo valve and the negative-side servo valve of all the air actuator 120, 130A, and 130B.

Figure 4:
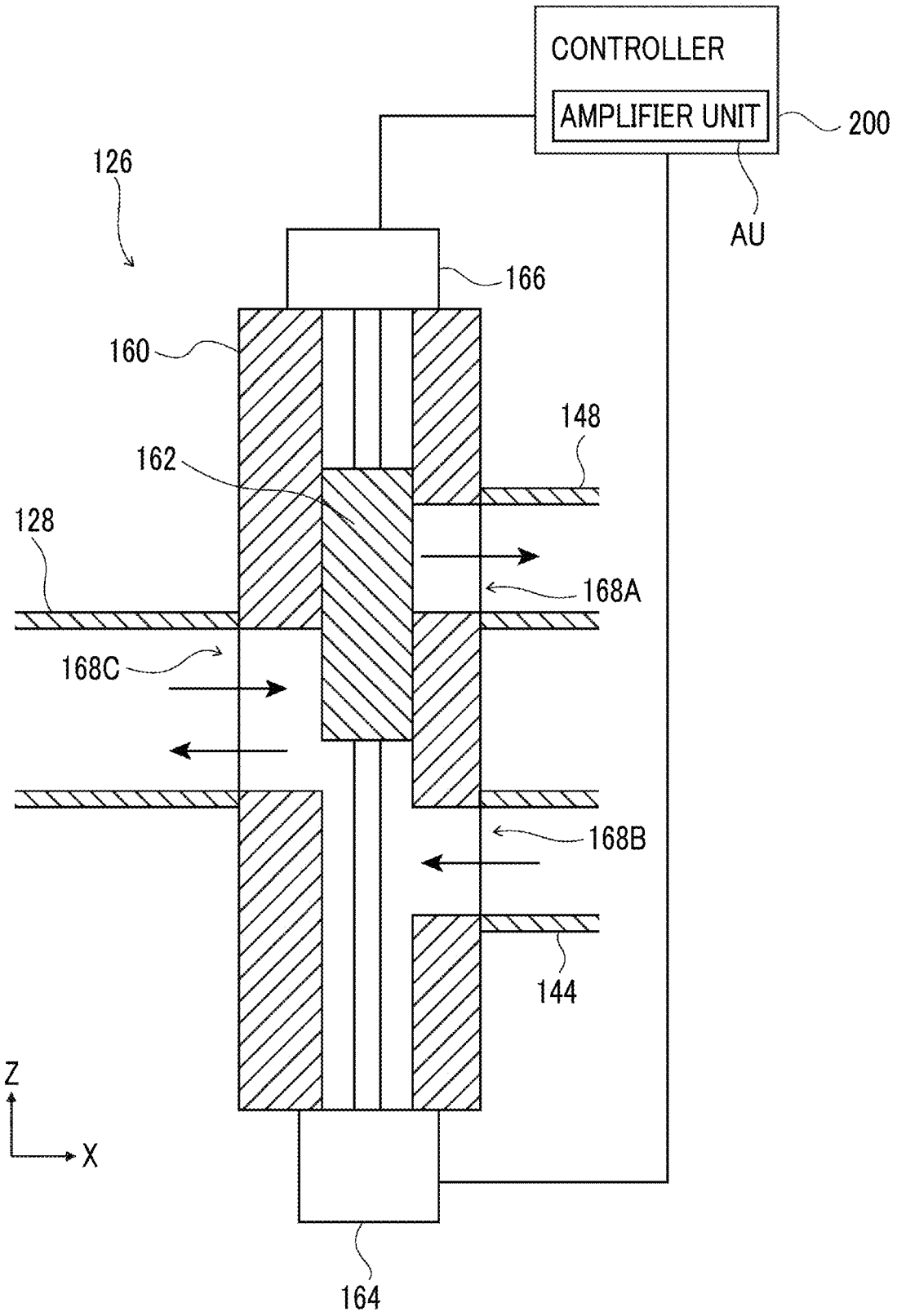
FIG. 4 is a cross-sectional view of a servo valve.

FIG. 4 is a cross-sectional view of the servo valve. Here, since the configurations of the positive-side servo valve 126P and the negative-side servo valve 126N are the same, the valves will be collectively described as a servo valve 126. Additionally, with respect to the configuration of respective parts of the servo valve 126, the terms "positive side" and "negative side" and the reference numerals "N" and "P" are omitted.

The servo valve 126 includes a main body 160, a spool 162 disposed in the main body 160, a motor 164, and a position sensor 166. The servo valve 126 is a three-way valve including three ports 168A, 168B, and 168C. The servo valve 126 switches a connection point of the port 168C between the port 168A or the port 168B depending on the position of the spool 162. The spool 162 is disposed in a flow path extending along the Z axis inside the main body 160 and is movable along the Z axis. The position of the spool 162 changes depending on the driving amount of the motor 164. The position sensor 166 measures the position of the spool 162. The two ports 168A and 168B lined up along the Z axis are provided on one side surface of the main body 160. The port 168A on the +Z side is connected to an air discharge pipe 148, and the port 168B on the −Z side is connected to an air supply pipe 144. The port 168A may be connected to the air supply pipe 144 and the port 168B may be connected to the air discharge pipe 148. The port 168C provided on the other side surface of the main body 160 is connected to a pipe 128. The measurement result of the position sensor 166 is supplied to an amplifier unit AU of the controller 200. The controller 200 detects the position of the spool 162 on the basis of the measurement result acquired by the amplifier unit AU, and controls the motor 164 on the basis of the position of the spool 162. As the controller 200 drives the motor 164 to control the position of the spool 162, the air supplied from the pump 146 is supplied to the servo chamber 150 through the servo valve 126, or the air in the servo chamber 150 is discharged to the outside through the servo valve 126. In FIG. 4, the servo valve 126 is disposed such that the spool 162 moves along the Z axis, but the direction in which the servo valve 126 is disposed is not limited to this.

Figure 5:
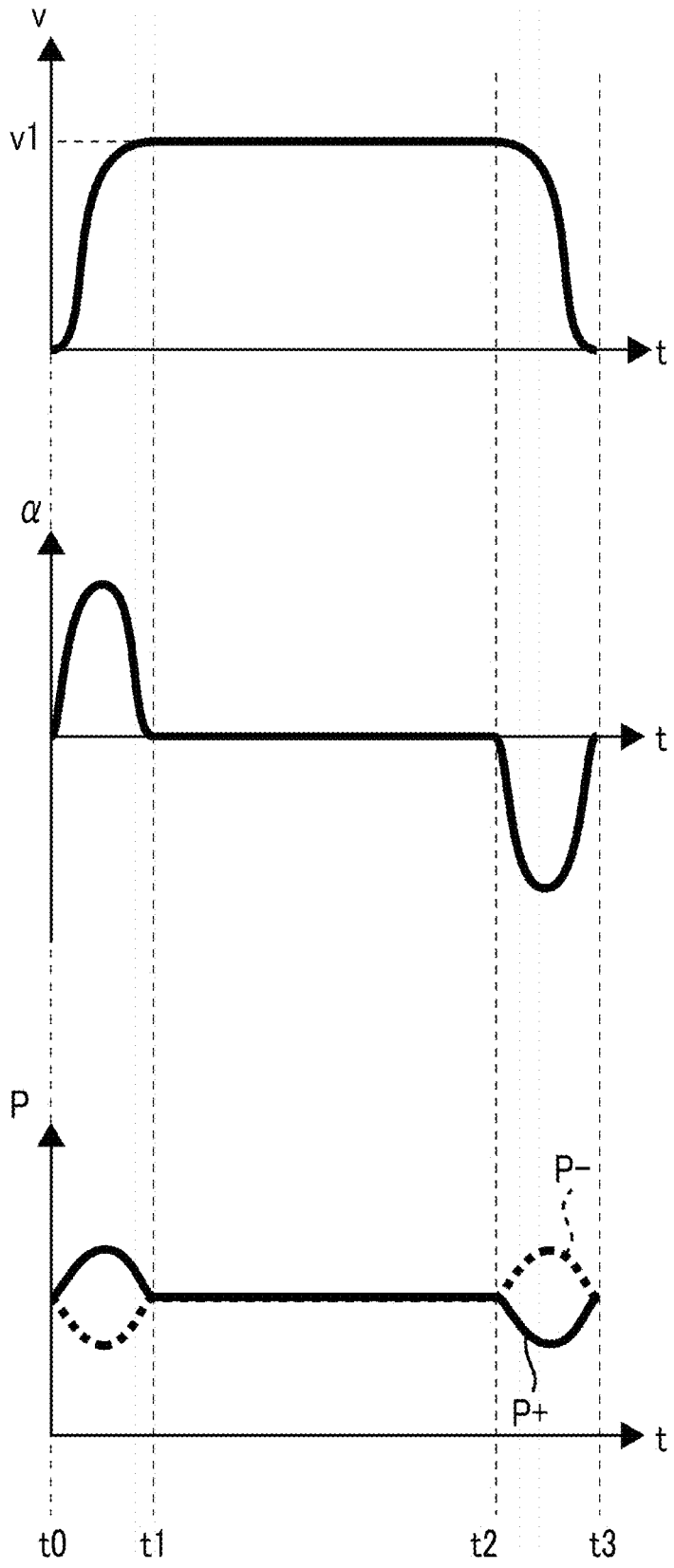
FIG. 5 is a view showing the operation of the air stage during normal operation.

Subsequently, the operation of the air stage 100 during normal operation will be described. FIG. 5 shows time-dependent changes of a velocity v of the slider 124, an acceleration $\alpha$ of the slider 124, and a pressure P in the servo chamber 150 during normal operation.

In a case where the slider 124 is moved to the positive side with reference to FIGS. 3 to 5, the controller 200 moves the spool 162 of the positive-side servo valve 126P to close the port 168A connected to the positive-side air discharge pipe 148P and open the port 168B connected to the positive-side air supply pipe 144P. At the same time, the controller 200 moves the spool 162 of the negative-side servo valve 126N to open the port 168A connected to the negative-side air discharge pipe 148N and close the port 168B connected to the negative-side air supply pipe 144N. Accordingly, air is supplied into the positive-side chamber 152 to increase the pressure P+, and air is discharged from the negative-side chamber 154 to decrease the pressure P− (time t0). When a differential pressure is generated between the pressure P+ and the pressure P−, the acceleration α increases and the slider 124 accelerates (time t0 to t1). The controller 200 controls the positive-side servo valve 126P and the negative-side servo valve 126N such that the differential pressure between the pressure P+ and the pressure P− becomes zero when the velocity v of the slider 124 reaches a predetermined velocity v1 (time t1 to t2). When the differential pressure becomes zero, the slider 124 moves at a constant speed.

Subsequently, the controller 200 decelerates the slider 124 such that the velocity v becomes zero when the slider 124 reaches a target position. In this case, the controller 200 moves the spool 162 of the positive-side servo valve 126P to open the port 168A connected to the positive-side air discharge pipe 148P and close the port 168B connected to the positive-side air supply pipe 144P. At the same time, the controller 200 moves the spool 162 of the negative-side servo valve 126N to close the port 168A connected to the negative-side air discharge pipe 148N and open the port 168B connected to the negative-side air supply pipe 144N. Accordingly, air is discharged from the positive-side chamber 152 to reduce the pressure P+, and air is supplied to the negative-side chamber 154 to increase the pressure P−. When a differential pressure is generated between the pressure P+ and the pressure P−, the acceleration α decreases and the slider 124 decelerates (time t2 to t3). The controller 200 stops the slider 124 by setting the differential pressure to zero when the slider 124 reaches the target position (time t3).

Subsequently, the features of the air stage 100 will be described.

Returning to FIG. 3, the X-axis air actuator 120 includes a positive-side pressure sensor 129P provided on the positive-side pipe 128P and a negative-side pressure sensor 129N provided on the negative-side pipe 128N. The positive-side pressure sensor 129P measures the pressure PX+ of the air that drives the slider 124 in the + X direction. The negative-side pressure sensor 129N measures the pressure PX− of the air that drives the slider 124 in the −X direction.

The pressure PX+ is equivalent to the pressure P+ in the positive-side chamber 152 in FIG. 5, and the pressure PX− is equivalent to the pressure P− in the negative-side chamber 154 in FIG. 5. As described with respect to FIG. 5, when the pressure P+ (PX+) in the positive-side chamber 152 rises (time t0 to t1), the slider 124 accelerates in the + X direction, and when the pressure P− (PX−) in the negative-side chamber 154 rises (time t2 to t3), the slider 124 accelerates in the −X direction. In this way, in order to schematically show that the pressure PX+ is the driving pressure for driving the slider 124 in the + X direction, the pressure PX+ is represented by a vector in the + X direction in FIG. 3. Similarly, in order to schematically show that the pressure PX− is the driving pressure for driving the slider 124 in the −X direction, the pressure PX− is represented by a vector in the −X direction in FIG. 3.

The pressures PX+ and PX− in the X direction are represented in FIG. 1B to the same effect. The same applies to the pressures PY1+, PY1−, PY2+, and PY2− in the Y direction shown in FIG. 1B. That is, in the Y-axis air actuator 130B constituting the Y1 axis, the pressure PY1+ is the driving pressure for driving the slider 134 in the + Y direction, and the pressure PY1− is the driving pressure for driving the slider 134 in the −Y direction. Similarly, in the Y-axis air actuator 130A constituting the Y2 axis, the pressure PY2+ is the driving pressure for driving the slider 134 in the + Y direction, and the pressure PY2− is the driving pressure for driving the slider 134 in the −Y direction. The driving pressures PY1+, PY1−, PY2+, and PY2− in the Y direction are individually measured by pressure sensors similar to the pressure sensors 129P and 129N shown in FIG. 3.

In FIG. 3, the controller 200 common to the X-axis air actuator 120 and the Y-axis air actuators 130A and 130B includes an acceleration detection unit 210 and a drive limiting unit 220. The acceleration detection unit 210 detects the acceleration generated in the slider 124 and the workpiece table 110 on the basis of the driving pressures PX+, PX−, PY1+, PY1−, PY2+, and PY2− measured by the respective pressure sensors in the respective drive directions. The drive limiting unit 220 limits the driving of the slider 124 and the workpiece table 110 in a case where the acceleration detected by the acceleration detection unit 210 exceeds a predetermined threshold.

With reference to FIG. 1B, accelerations in respective directions generated in the drive target W detected by the acceleration detection unit 210 will be described. On the basis of the equation of motion, the translational acceleration is represented by "force/mass" and the rotational acceleration is represented by "torque/moment of inertia". The force in each drive direction is obtained by multiplying the pressure caused by the air by the cross-sectional area. In the following, it is assumed that the cross-sectional areas of air in the respective directions are equal as S. In this case, a resultant force FX in the X direction is ((PX+)−(PX−)) S, and a resultant force FY in the Y direction is ((PY1+)+(PY2+)−(PY1−)−(PY2−)) S. The origin when considering the rotary motion can be optionally set, but for example, as shown in the figure, the point O on the Y1 axis is set as the origin. The torque N around an origin O is the sum of torques obtained multiplying a force caused by each driving pressure by each vertical distance (arm lengths) from the origin O.

The drive target Win the translational motion in the X direction is the slider 124, the workpiece table 110, and a placed object placed on the workpiece table 110, and the total mass of these objects is m. Additionally, in the translational motion in the Y direction, since the entire X-axis air actuator 120 including the above is driven, m+M including the residual mass M becomes the mass of the drive target W. Even in the rotary motion, the rotation of the entire X-axis air actuator 120 becomes a problem. Therefore, m+M is the mass of the drive target W. The moment of inertia I around the origin O is obtained by approximating the drive target W of mass m+M with an appropriate number of mass points and the sum of moments of inertia obtained by multiplying the mass of each mass point by the squared of each vertical distance (arm length) from the origin O.

On the basis of the above respective elements, the accelerations in the respective directions can be obtained as follows.

Translational acceleration αX in X direction: FX/m

Translational acceleration αY in Y direction: FY/(m+M)

Rotational acceleration αθ origin O: N/I

The drive limiting unit 220 of FIG. 3 limits the drive of the drive target W in a case where the acceleration in each of the above directions exceeds a predetermined threshold and becomes excessive. For example, in a case the acceleration in any direction becomes excessive, all the servo valves 126 and 136 of the air stage 100 are connected to the air discharge pipe 148 to perform the emergency exhaust. Accordingly, the pressure of the air in the air stage 100 drops sharply, and the air stage 100 can be safely stopped. In addition, instead of connecting all the servo valves to the air discharge pipe, only the servo valves that contribute to a drive direction in which an excessive acceleration is detected may be connected to the air discharge pipe to perform the emergency exhaust. Additionally, by providing the pipe 128 with an exhaust valve that is opened at the time of the emergency exhaust, the pipe 128 may be configured to perform the emergency exhaust. Moreover, the drive limiting unit 220 may send an emergency control command for generating a driving pressure in the direction in which the excessive acceleration is offset to the servo valves 126 and 136, instead of performing the emergency exhaust.

Figure 6:
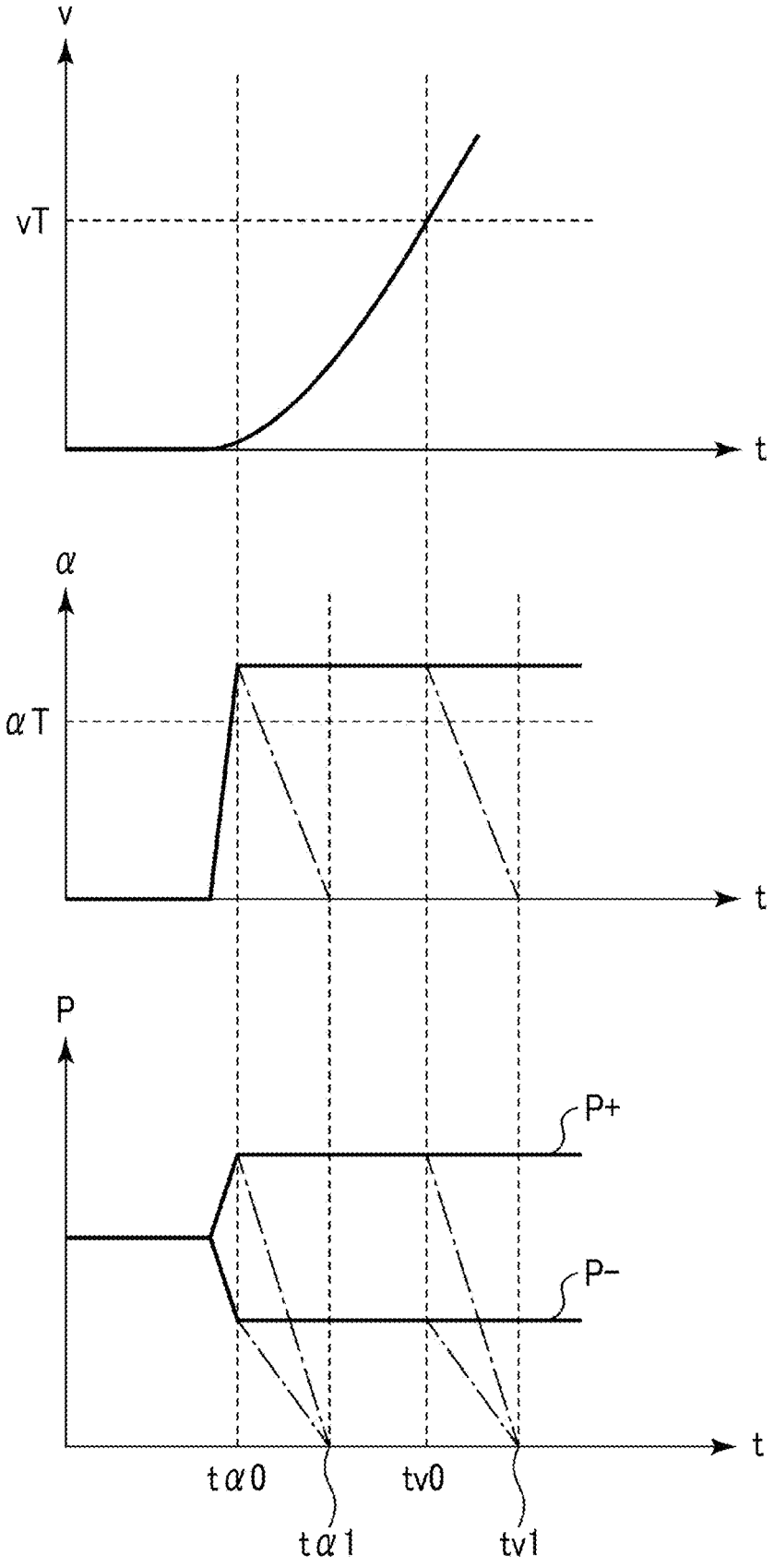
FIG. 6 is a view showing an example of drive limitation in a case where the translational acceleration along any of drive axes becomes excessive.
Figure 7:
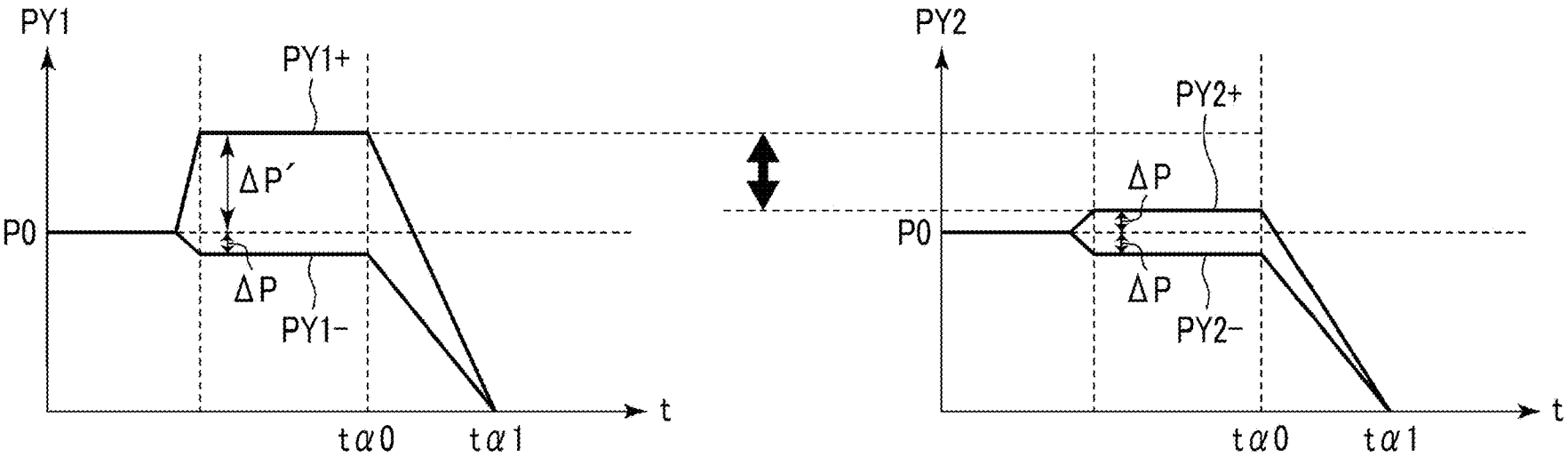
FIG. 7 is a view showing an example of drive limitation in a case where the rotational acceleration of a drive target becomes excessive.

FIGS. 6 and 7 show an example of drive limitation by the drive limiting unit 220. FIG. 6 shows an example of drive limitation in a case where the translational acceleration along any drive axis of the X axis, Y1 axis, and Y2 axis becomes excessive, and shows the time-dependent changes of the velocity v of the sliders 124 and 134, the translational acceleration a of the slider 124 and 134, and the pressure P in the servo chamber 150, similar to FIG. 5. A threshold vT is set for the velocity v, and when the threshold vT is exceeded, the air stage 100 is emergency-stopped. The time when the velocity v reaches the threshold vT and the emergency exhaust of the servo valves 126 and 136 starts is defined as tv0, and the time when the emergency exhaust is completed is defined as tv1. A threshold αT is set for the translational acceleration α, and when the threshold αT is exceeded, the air stage 100 is emergency-stopped. The time when the translational acceleration α reaches the threshold αT and the emergency exhaust of the servo valves 126 and 136 starts is defined as tα0 and the time when the emergency exhaust is completed is defined as tα1.

As is clear from the figure, the air stage 100 earlier than the threshold control based on the velocity v can be emergency-stopped by the threshold control based on the translational acceleration α (tα1<tv1). Additionally, in the threshold control based on the velocity v, the velocity v of the drive target W is as high as vT at the time tv0 when the emergency exhaust starts. For this reason, even when the emergency exhaust is performed from the time tv0 and the translational acceleration α becomes zero at the time tORDOv1, time is further required until the drive target W finally stops due to the inertia of the drive target W during high-speed movement. In contrast, in the threshold control based on the translational acceleration α, the velocity v of the drive target W is almost zero at the time tα0 when the emergency exhaust starts. For this reason, when the emergency exhaust is performed from time tα0 and the translational acceleration a becomes zero at time tad, the drive target W during low-speed movement finally stops soon. In this way, according to the threshold control based on the translational acceleration α, the emergency exhaust can be started before the velocity v of the drive target W becomes high. Thus, the air stage 100 can be rapidly and safely emergency-stopped. In particular, in the air stage 100 in which the drive target W is driven in a state where the air stage have floated due to the pressure of air, it is difficult to easily stop the drive target W once the speed becomes high. Therefore, this point is extremely important.

In addition, the translational acceleration α can also be obtained by second-order differentiating the positions measured by the position sensors 140 and 142 with respect to time. However, since it is necessary to accumulate measurement data for a certain period of time for differential calculation, it may not be suitable for the above-mentioned situation having a high emergency. On the other hand, as described with respect to FIG. 1B, according to the driving pressures PX+, PX−, PY1+, PY1−, PY2+, and PY2− measured by the pressure sensors, the translational accelerations αX and αY can be directly calculated. Thus, the stop processing of the air stage 100 can be rapidly started even in a situation having a high emergency. Additionally, even in a case where the position sensor 140 and 142 fail, when the pressure sensor is normally operating, the emergency stop processing can be performed. Thus, the robustness of the system is improved.

FIG. 7 shows an example of drive limitation in a case where the rotational acceleration of the drive target W becomes excessive, and shows the time-dependent changes of the driving pressure PY1 of the Y-axis air actuator 130B constituting the Y1 axis and the driving pressure PY2 of the Y-axis air actuator 130A constituting the Y2 axis. As described with respect to FIG. 1B, the rotational acceleration can be accurately calculated by the mechanical calculation based on the driving pressures PX+, PX−, PY1+, PY1−, PY2+, PY2− measured by the pressure sensors and the relative positions of the drive target W with respect to the drive axes X, Y1, and Y2. However, in the example of this figure, the generation of undesired rotational acceleration is simply detected on the basis of the comparison between the pressures PY1+ and PY2+ in the positive directions of the respective axes and the comparison between the pressures PY1− and PY2− in the negative directions of the respective axes.

During normal operation when no rotational acceleration is generated, the translational acceleration generated on the Y1 axis and the translational acceleration generated on the Y2 axis are equal to each other. Accordingly, the X-axis air actuator 120 as the drive target in the Y direction is driven in the Y direction while maintaining a state where the X-axis air actuator 120 is parallel to the X direction and perpendicular to the Y direction. In this case, the graphs of PY1 and PY2 in FIG. 7 become the same. Specifically, as shown in the graph of PY2, PY2+ and PY2− when a differential pressure (translational acceleration in the Y direction) is generated change in opposite directions by the same amount ΔP with respect to an initial pressure P0. However, in the shown example, an abnormality occurs in the driving pressure PY1+ in the positive direction of PY1, and a change of an amount ΔP' larger than the desired amount of change ΔP is observed. In this case, the acceleration detection unit 210 performs the comparison between PY1+ and PY2+ and the comparison between PY1− and PY2−, respectively. In the former comparison, a differential pressure of ΔP'−ΔP is detected between PY1+ and PY2+. In the latter comparison, since PY1− and PY2− are the same, no differential pressure is detected. On the basis of these comparisons, the acceleration detection unit 210 detects that the rotational acceleration in the clockwise direction in FIG. 1B is generated because of PY1+>PY2+. Since the driving for causing the rotational acceleration is not assumed in the air stage 100 of the present embodiment, the drive limiting unit 220 has a substantially zero threshold for the rotational acceleration.

Accordingly, as shown in FIG. 7, in a case where the pressures on the Y1 axis and the Y2 axis are unbalanced, the drive limiting unit 220 is determined to be abnormal and the air stage 100 is emergency-stopped. Similarly to FIG. 6, the time when the emergency exhaust of the servo valve 136 starts is defined as tα0, and the time when the emergency exhaust is completed is defined as tad.

The present invention has been described above on the basis of the embodiment. The embodiment is an example, and it will be understood by those skilled in the art that various modification examples are possible for the combinations of these respective components and the respective processing processes and that such modification examples are also within the scope of the present invention.

In the embodiment, the air actuator using air as the working fluid has been described, but the fluid actuator of the present invention may use a fluid other than this as the working fluid. For example, a hydraulic actuator using oil as the working fluid, a hydraulic actuator using water as the working fluid, or a gas actuator using an optional gas other than air as the working fluid may be used.

In addition, the functional configurations of the respective devices described in the embodiment can be realized by hardware resources or software resources or by the collaboration between the hardware resources and the software resources. Processors, ROMs, RAMs, and other LSIs can be used as the hardware resources. Programs such as operating systems and applications can be used as the software resources.

It should be understood that the invention is not limited to the above-described embodiment, but may be modified into various forms on the basis of the spirit of the invention. Additionally, the modifications are included in the scope of the invention.

What is claimed is:

1. A fluid actuator comprising:

a first pressure sensor configured to measure a pressure of a working fluid configured to drive a drive target in a first drive direction;

a second pressure sensor configured to measure a pressure of the working fluid configured to drive the drive target in a second drive direction different from the first drive direction;

an acceleration detector configured to detect an acceleration generated in the drive target on the basis of the pressure measured by the first pressure sensor and the pressure measured by the second pressure sensor; and a drive limiter configured to limit driving of the drive target, wherein, when the acceleration exceeds a predetermined threshold, the drive limiter is configured to determine that an abnormality has occurred.

2. The fluid actuator according to claim 1, wherein a second driver configured to drive the drive target along a second drive axis with the working fluid, and a third driver is configured to drive the drive target along a third drive axis parallel to the second drive axis with the working fluid are provided with the drive target interposed therebetween, the first drive direction is a direction along the second drive axis, and the second drive direction is a direction along the third drive axis, and the acceleration detector is configured to detect an acceleration in a rotational direction generated in the drive target by the second driver and the third driver.

3. A stage device comprising a plurality of the fluid actuators including the fluid actuator according to claim 2.

4. The fluid actuator according to claim 1, wherein the working fluid is a gas, and the drive target is driven in a floating state by a pressure of the gas.

5. A stage device comprising a plurality of the fluid actuators including the fluid actuator according to claim 4.

6. The fluid actuator according to claim 1, wherein, when the drive limiter determines that an abnormality has occurred, an emergency stop is performed.

7. A stage device comprising a plurality of the fluid actuators including the fluid actuator according to claim 6.

8. A stage device comprising a plurality of the fluid actuators including the fluid actuator according to claim 1.

9. A fluid actuator control method comprising:

measuring a pressure of a working fluid configured to drive a drive target in a first drive direction, by a first pressure sensor;

measuring a pressure of the working fluid configured to drive the drive target in a second drive direction different from the first drive direction, by a second pressure sensor;

detecting, by an acceleration detector, an acceleration generated in the drive target on the basis of the pressure measured by the first pressure sensor and the pressure measured by the second pressure sensor; and determining, by a drive limiter, that an abnormality has occurred when the acceleration exceeds a predetermined threshold.

10. A non-transitory computer readable medium storing a control program of a fluid actuator, the control program causing a computer to execute a process comprising:

measuring a pressure of a working fluid configured to drive a drive target in a first drive direction, by a first pressure sensor;

measuring a pressure of the working fluid configured to drive the drive target in a second drive direction different from the first drive direction, by a second pressure sensor;

detecting, by an acceleration detector, an acceleration generated in the drive target on the basis of the pressure measured by the first pressure sensor and the pressure measured by the second pressure sensor; and determining, by a drive limiter, that an abnormality has occurred when the acceleration exceeds a predetermined threshold.

* * * * *